United States Patent [19]

McFee

[11] Patent Number: 4,470,597

[45] Date of Patent: Sep. 11, 1984

[54] EXERCISER WITH FLYWHEEL

[76] Inventor: Richard McFee, R.D. #1, Union Springs, N.Y. 13160

[21] Appl. No.: 370,078

[22] Filed: Apr. 20, 1982

[51] Int. Cl.[3] ..... A63B 23/04

[52] U.S. Cl. ..... 272/128; 272/144

[58] Field of Search ..... 272/65, 72, 73, 97, 272/128, 129, 134, 137, 138, 144, DIG. 4

[56] References Cited

U.S. PATENT DOCUMENTS

| | | | |
|---|---|---|---|
| 3,531,112 | 9/1970 | Gibbs | 272/73 X |
| 3,747,924 | 7/1973 | Champoux | 272/DIG. 4 X |
| 4,077,626 | 3/1978 | Newman | 272/128 |
| 4,261,562 | 4/1981 | Flavell | 272/129 |
| 4,341,380 | 7/1982 | Sauder | 272/65 |

*Primary Examiner*—Richard T. Stouffer

*Attorney, Agent, or Firm*—Francis C. Hand

[57] ABSTRACT

The exerciser has a platform which is moved up and down rhythmically by the user to impart energy to a rotating fly wheel. Energy is imparted to the fly wheel by flexing of the knees during the up and down motion or by a rhythmic lifting of weights by the user or by grasping onto the hand rails of the exerciser. The exerciser can be constructed to adjust the extent of the vertical motion of the platform via an internal linkage. Further, the energy delivered by the user to the exerciser can be dissipated through various devices such as an alternator connected to an adjustable resistor.

22 Claims, 8 Drawing Figures 10
11
12
13
14
15
16
17
18
19
20
23
24
25
26
27
28
29
30
31
32
33
34
35
36
37
U

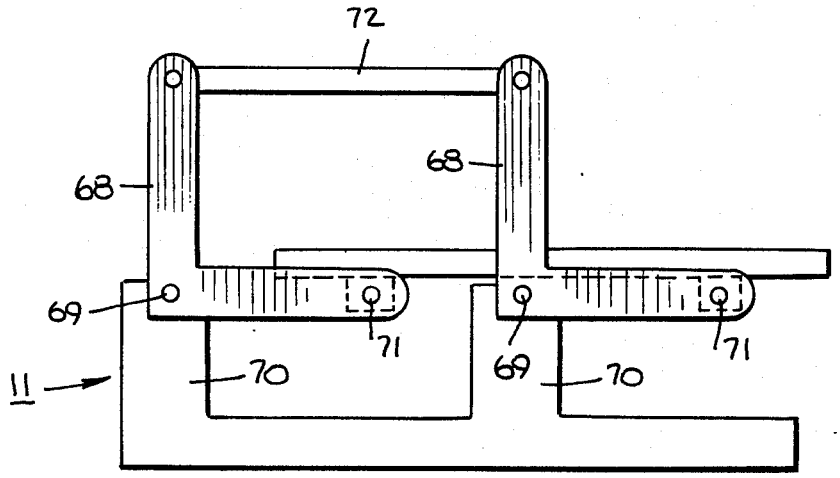
Fig. 3.
Fig. 4.
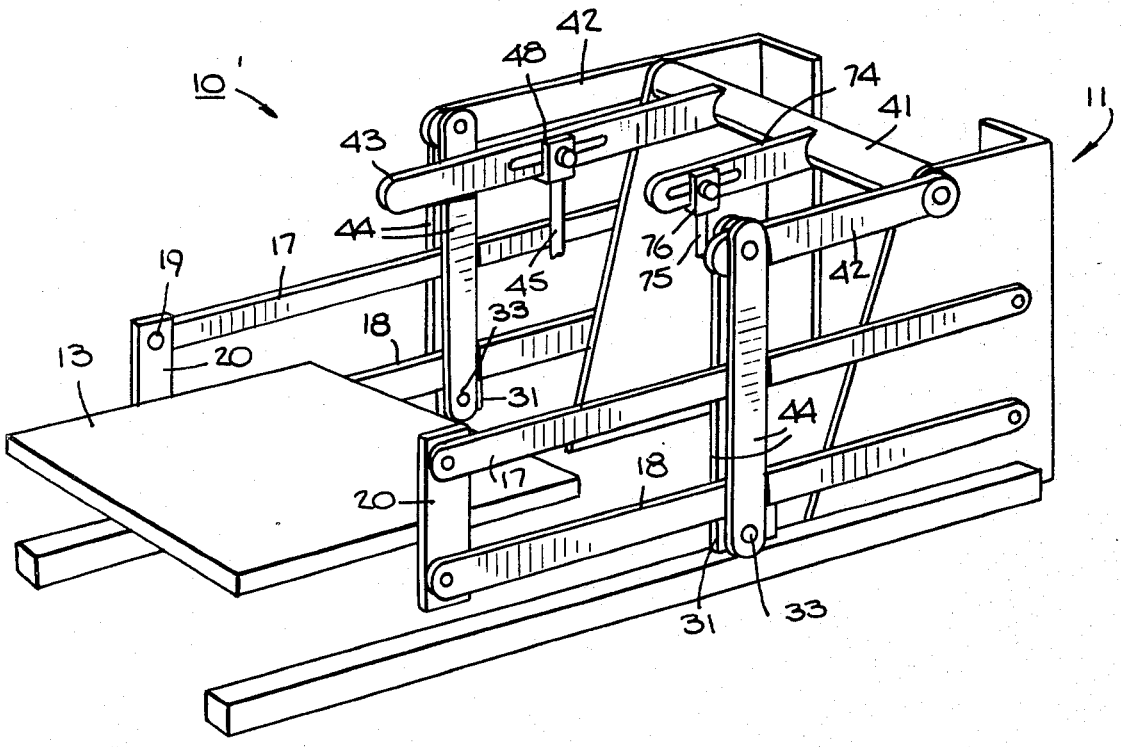

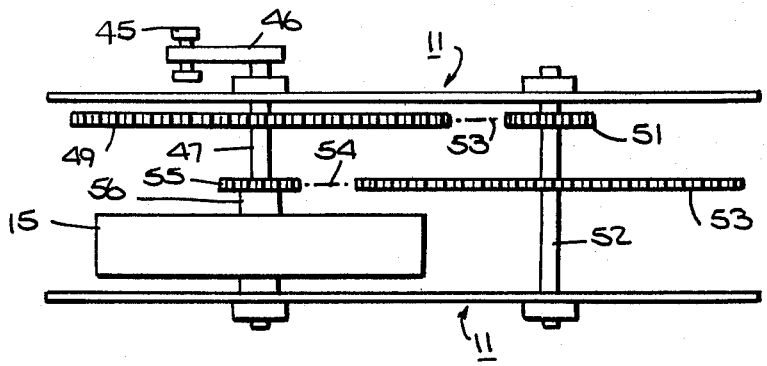
Fig. 5.
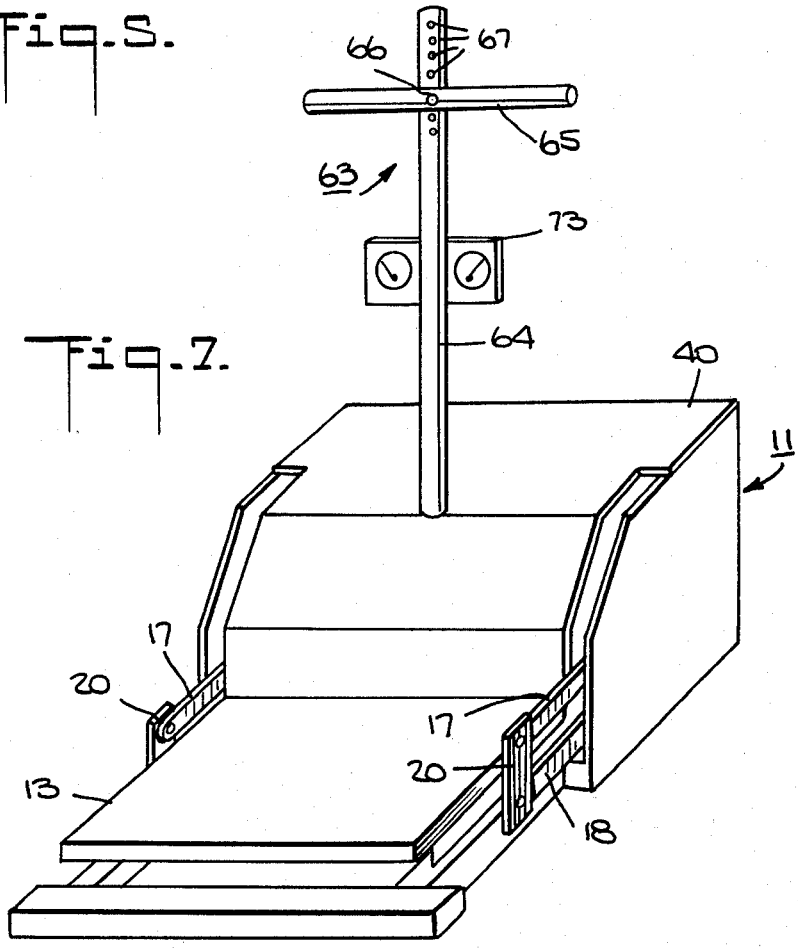
Fig. 7.
Fig. 6.
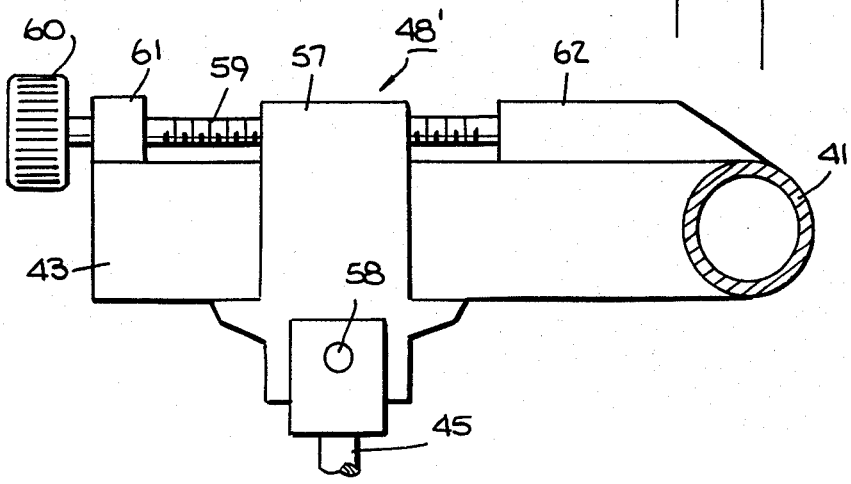

EXERCISER WITH FLYWHEEL

This invention relates to an exerciser. More particularly, this invention relates to knee flex exerciser.

As is known, various types of exercise programs have been developed to stimulate the heart rate and breathing rate in order to decrease the likelihood of disease of the circulatory system. Such exercise programs have also been designed to help combat anxiety and depression. Examples of the types of exercise which are usually suggested in this regard are the exercise provided by jogging, swimming and active team sports such as baksetball and soccer. Further, in order to supplement or replace these exercises, it has been known to use exercise bicycles, rowing machines and treadmills in a home or gymnasium. However, experience has shown that these latter types of machines are less than ideal because the exercise is tedious, enthusiasm wanes and the use of the machine is discontinued.

Apart from the above conventional types of exercise machines, other types of exercise machines have been known for exercising specific parts of the human body. For example, U.S. Pat. No. 4,151,839 describes an exercise machine for the legs and lower trunk of the human body which employs a plate and a means for oscillating the plate up and down in a simple harmonic motion. The drive for the machine is provided by a motor and a flywheel which is connected by a rod to a reciprocating piston. Such a machine, however, is used in a "passive" manner. That is, the machine does the work while the user simply rides on the moving plate.

Other exercise devices are also known which are of the "active" type, that is, machines in which the person imparts energy to the machine. Examples of such exercise machines are described in U.S. Pat. Nos. 3,831,935 and 3,874,656. However, such machines are generally of the reaction type wherein the user moves against the force of a spring. Other types of active exercise machines are also described in U.S. Pat. Nos. 2,387,966 and 1,899,255 wherein the user imparts work against a flywheel arrangement. However, these machines use one limb to actuate the machine to exercise another limb. Generally, these machines are cumbersome in construction and use.

Accordingly, it is an object of the invention to provide an exerciser which provides an inexpensive and compact arrangement for stimulating the heart rate and breathing rate.

It is another object of the invention to provide an exerciser of the active type which requires an input of energy from the user for use.

It is another object of the invention to provide an exerciser which operates in a non-tedious pleasant manner.

It is another object of the invention to provide an exerciser which is particularly beneficial for knees.

It is another object of the invention to provide an exerciser wherein an exact measurement of work can be made.

Briefly, the invention provides an exerciser which is constructed with a load receiving member upon which a user may stand, at least one arm assembly which is articulated to the member for mounting the member for reciprocation in a vertical direction, a rotatably mounted flywheel, and a conversion means which connects the arm assembly with the flywheel in order to convert a reciprocating motion of the load receiving member to a rotary motion of the flywheel.

During use, the exerciser simulates the type of exercise received, for example when a skier traverses "moguls", or when a diver bounds up and down on a diving board or a gymnast jumps on a trampoline. In this regards, both knees of the user are flexed in unison rather than alternately as they would be with a bicycle, treadmill or exercise stair.

The exerciser is constructed so that the load receiving member is made to move up and down in a rhythmic manner via the connection to the flywheel which revolves at nearly constant speed. By flexing the knees with proper timing, and/or lifting and lowering weights held in the hands, and/or clutching handrails anchored to the exerciser, the pressure of the feet on the load receiving member is made greater during the downstroke when the flywheel is accelerated than during the upstroke when the flywheel is slowed. The net result is that energy is given to the load receiving member by the user for each cycle. This energy may be used to speed up the flywheel or to compensate for losses which are inherent in the exerciser or to react against losses which are deliberately added to the exerciser so as to increase the effort required of the user.

In one embodiment, the load receiving member is in the form of a platform which is carried on a pair of arm assemblies, for example of the parallelogram type. The arm assemblies are in turn pivotally mounted in a stationary support frame. In addition, the conversion means includes connecting rods and cranks which connect the arm assemblies to a crankshaft which rotates in response to the up and down motion of the platform. The crankshaft is, in turn, connected via a change speed transmission to the flywheel so as to impart rotation to the flywheel.

The exerciser may also have a means connected to the flywheel for dissipating energy from the flywheel. For example, use may be made of an adjustable friction brake. Alternatively, use may be made of an alternator which is connected to a hub of the flywheel and an adjustable resistor which is connected to the alternator.

In another embodiment, the exerciser mounts the load receiving platform via a pair of arm assemblies for an up and down vertical motion while the arm assemblies are connected via connecting rods and cranks to a support shaft which is able to oscillate within the support frame. In this embodiment, the support shaft carries a crank which is connected via an adjustable rod and crank to a crankshaft. As with the first embodiment, the crankshaft is connected via a change speed transmission to the flywheel which rotates concentrically with the crankshaft.

In this latter embodiment, the excursion of the platform can be varied by adjusting the position of the rod on the crank between the support shaft and the crankshaft.

In addition, an extra load can be imposed on the exerciser via a further crank on the support shaft which can be connected, for example, to a shock absorber.

The exerciser may also be provided with at least one upstanding hand rail which can be grasped by the user during use. Further, the hand rail may be used to support a read-out means by which the energy being produced by the user can be indicated.

In still another embodiment, the platform may be supported on the support frame by pairs of rocker arms of L-shape on each side. In this embodiment, the rocker arms are pivotally mounted on the support frame with horizontal legs connected to the platform and with vertical legs connected to each other in a parallogram arrangement. The rearmost rockers are coupled together via a shaft which can be rocked back and forth by connection to a crankshaft which is, in turn, connected to a flywheel. This arrangement permits the exerciser to be constructed in a more compact manner.

These and other objects and advantages of the invention will become more apparent from the following detailed description taken in conjunction with the accompanying drawings wherein:

FIG. 4 illustrates a modified embodiment of an exerciser constructed in accordance with the invention;

FIG. 5 illustrates a top view of the transmission of the exerciser of FIG. 4;

FIG. 6 illustrates a means of adjusting a connecting rod on a crank of the support shaft of the exerciser of FIG. 4;

FIG. 7 illustrates a perspective view of the exerciser of FIG. 4 with an upstanding hand rail and a read-out means; and FIG. 8 illustrates a side view of a modified arm assembly for a platform in accordance with the invention.

Figure 1:
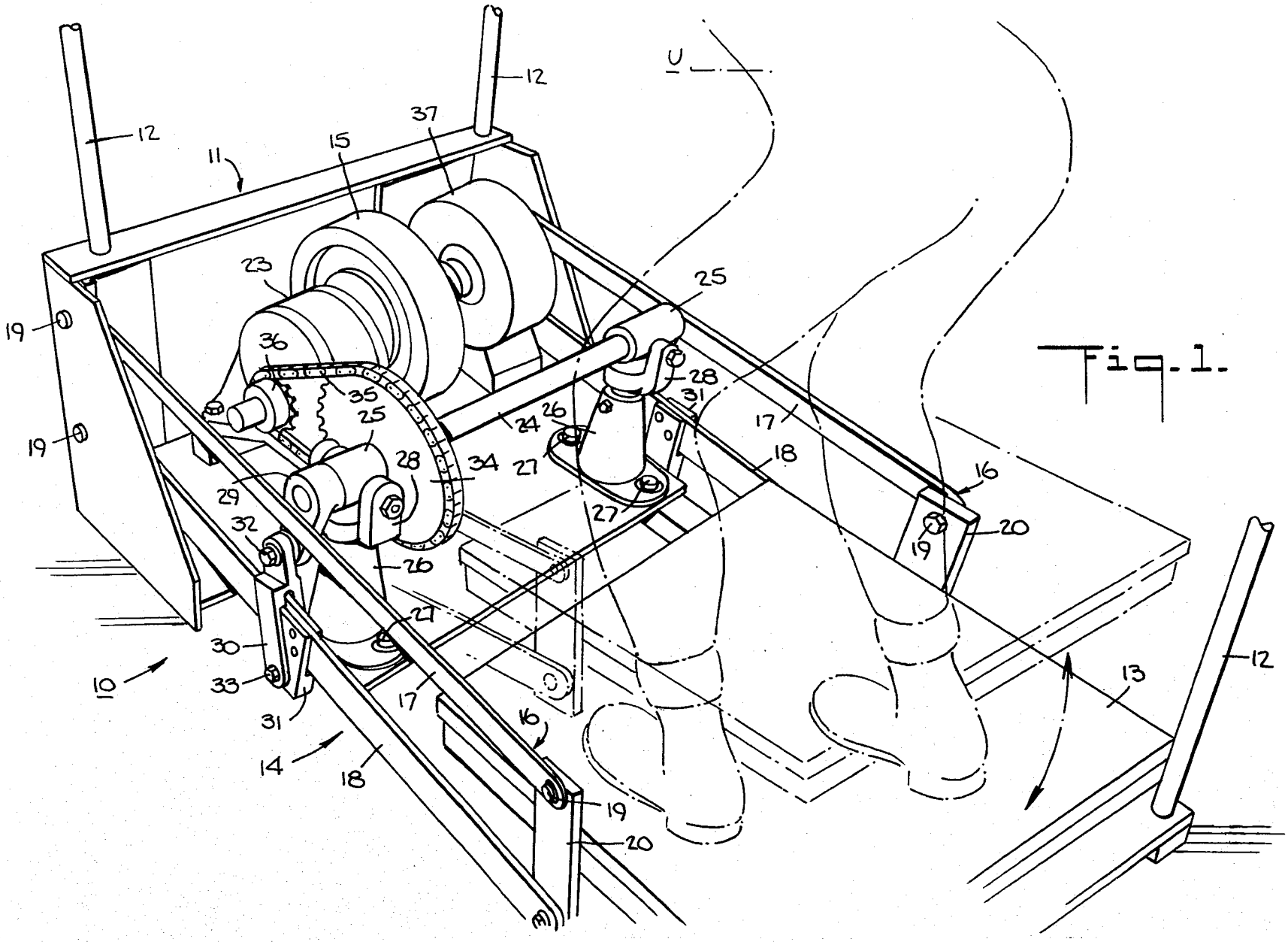
FIG. 1 illustrates a perspective view of an exerciser constructed in accordance with the invention.

Referring to FIG. 1, the exerciser 10 is constructed as a knee flex exerciser. As shown, the exerciser 10 includes a stationary support frame 11 on which a pair of upstanding hand rails 12 are mounted for purposes as described below. The exerciser 10 also includes a load receiving member 13 in the form of a platform, means 14 for mounting the platform on the frame 11 for reciprocating in a substantially vertical path, a flywheel 15 which is rotatably mounted in the frame 11 and means which connect the platform 13 with the flywheel 15 for transmitting a reciprocating up and down motion of the platform 13 to a rotary motion of the flywheel 15 and vice versa.

The platform 13 is constructed with a rectangular shape so as to provide a surface on which a user U may stand. Alternatively, the platform may be constructed of a pair of foot supports which are connected together.

Figure 3:
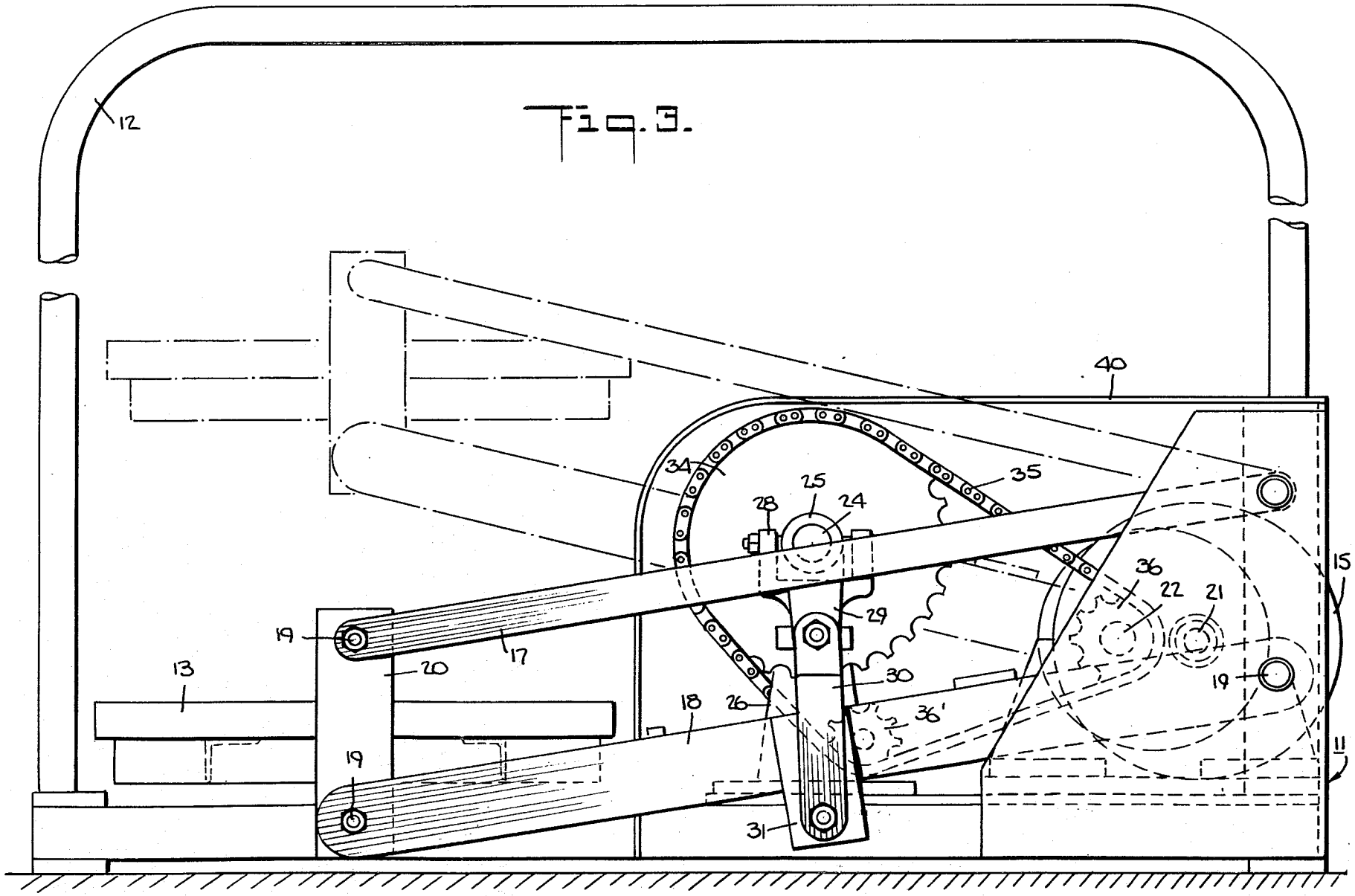
FIG. 3 illustrates a part cross-sectional side view of the exerciser of FIG. 1.

The means 14 for mounting the platform includes a pair of arm assemblies 16, each of which is articulated to the platform 13 for guiding the platform 13 in a vertical path. As shown in FIG. 3, each arm assembly 16 is in the form of a parallelogram arrangement. That is, each arm assembly 16 includes a pair of struts 17, 18 which are pivotally connected via pivots 19 to the support frame 11 at one end in fixed relation and to a vertical bar 20 via pivots 19 at the opposite end. The vertical bar 20 is, in turn, fixedly connected to the platform 13 in a suitable manner (not shown). The parallelogram arrangement of the struts 17, 18 serves to keep the platform 13 level.

The means which connects the platform 13 to the flywheel 15 employs a high speed shaft 21 (FIG. 2) on which the flywheel 15 is mounted, a low speed shaft 22, and a speed change transmission 23 which connects the high speed shaft 21 to the low speed shaft 22. In addition, this means includes a conversion means which connects the low speed shaft 22 to the arm assemblies 16 in order to convert a reciprocating vertical motion of the platform 13 to a rotary motion of the shaft 22. This conversion means includes a crankshaft 24 which is rotatably mounted via suitable bearings 25 on bearing mounts 26. As indicated in FIG. 1, each bearing mount 26 is bolted via bolts 27 to the support frame 11 and includes a yoke 28 by means of which the crankshaft 24 may be raised and lowered vertically at each end. The crankshaft 24 carries a crank 29 on each end which is connected via a connecting rod 30 to a U-shaped bracket 31 fixed to the lower strut 18 of a respective arm assembly 16. As indicated in FIG. 1, each connecting rod 30 is pivotally connected to a crank 29 via a suitable pivot pin 32 or the like as well as to a bracket 31 via a pivot pin 33 or the like.

The crankshaft 24 also carries a large sprocket 34 which is connected via a chain 35 to a small sprocket 36 on the low speed shaft 22. A suitable sprocket 36' is also provided (FIG. 3) for tensioning the chain 35.

Figure 2:
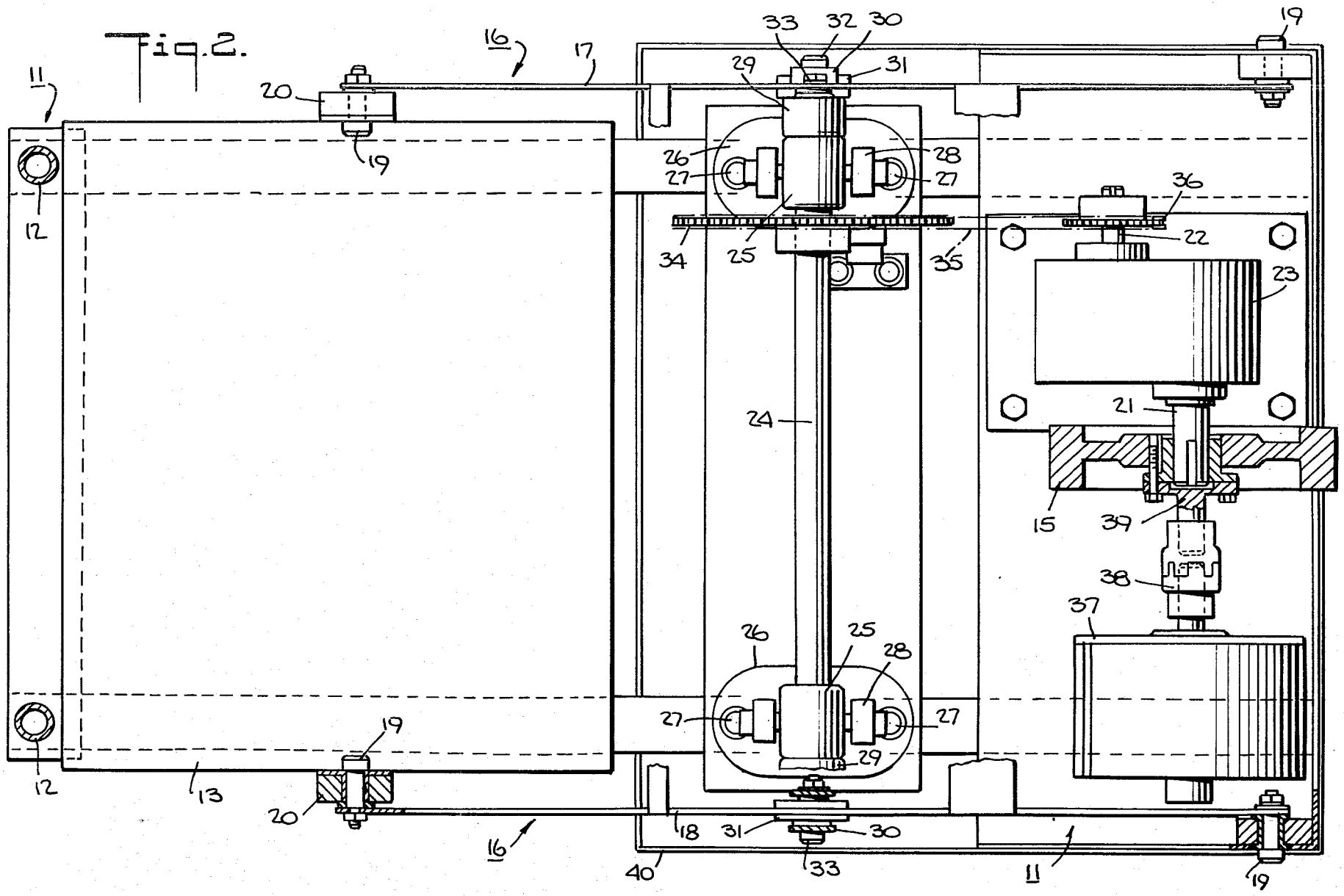
FIG. 2 illustrates a top view of the exerciser of FIG. 1.

Referring to FIG. 2, an alternator 37 is also mounted in the support frame 11 and is connected via a suitable coupling 38 to a hub 39 of the flywheel 15 for purposes as explained below.

Finally, a shroud 40 is placed over the rotating parts of the exerciser 10 as indicated in FIGS. 2 and 3.

In order to operate the exerciser 10, the flywheel 15 is set so that the platform 13 is not all the way down. The user U then pumps the platform 13 with one foot a few times so that the flywheel 15 begins to rotate rapidly in one direction with the platform 13 moving up and down at a rate of, for example, one oscillation per second. The user U then steps on the platform 13 with both feet and, by flexing his knees, rides the exerciser 10 and increases the speed further.

As the platform 13 reciprocates vertically, the arm assemblies 16 also pivot up and down with this motion being translated via the connecting rods 30 to the cranks 29 on the crankshaft 24. The subsequent rotation of the crankshaft 24, in turn, causes rotation of the low speed shaft 22 and, via the transmission 23, the high speed shaft 21 on which the flywheel 15 is mounted.

By flexing the knees with proper timing and/or clutching the handrails 12, the pressure on the platform 13 is made greater during the downstroke so as to accelerate the flywheel 15 than during the upstroke when the flywheel 15 is raising the platform 13.

The various components of the exerciser 10 may be dimensioned as follows. For example, the gear ratio between the crankshaft 24 and the low speed shaft 22 may be from 1:2 to 1:6. Likewise, the transmission 23 may provide a gear ratio of from 1:4 to 1:15. The overall ratio of speed between the crankshaft 24 and the flywheel 15 may be in the range of from 1:15 l to 1:66. For example, for a speed ratio of 30 to 1, and a platform cycle of 1.5 times per second, the flywheel 15 will rotate at 45 revolutions per second. If the rim weight of the flywheel 15 is five kilograms and the radius is 0.1 meter, then the rim speed will be 28 meters per second with a kinetic energy ($1/2\ Mv^2$) of 2,000 joules. This is enough to raise a 100 kilogram user about 2 meters. Thus, in use, where the lift of the platform 13 is in the range of 8 to 30 centimeters, only a small fraction of the energy of the flywheel 15 is drained in a single lift. Thus, the speed of the flywheel 15 can be nearly constant.

If the user U carries weights, such as bar bells, when mounting the exerciser 10 and lifts these weights rhythmically during flexing of the knees, the energy delivered per cycle can be increased. While experienced use of the exerciser 10 may not require the hand rails 12, the hand rails 12 can provide a steadying point for initial users.

The exerciser 10 can be constructed with low internal losses due to friction between the various working elements so that the user U can ride the exerciser for relatively long periods of time, for example for 30 minutes or so with relatively slight knee flexing and little strain. However, the effort required can be increased by deliberately adding losses, for example by connecting the flywheel 15 to the alternator 36 and by having the electrical output of the alternator 36 dissipated in an adjustable resistor (not shown). Alternatively, an adjustable friction brake (not shown) can be added about the flywheel 15 to impose a drag loss.

Referring to FIGS. 4 to 7, wherein like reference characters indicate like parts as above, the maximum frequency at which the exerciser 10′ can be operated can be increased if the vertical excursion of the platform 13 is decreased. The increased frequency of motion of the platform 13 would then give the user a lighter, more exuberant feeling. For example, the minimum excursion may be in the order of $\frac{1}{8}$ meter with a maximum in the order of $\frac{1}{4}$ meter. To this end, an internal linkage is provided in the exerciser 10′. For example, as shown in FIG. 4, the linkage includes a support shaft 41 which is rotatably mounted in the support frame 11 and which carries a crank 42 at each end as well as an intermediate crank 43 near one end. Each of the end cranks 42 is connected via connecting rods 44 to the lower strut 18 of an arm assembly 16 in a manner similar to that described above. The intermediate crank 43 carries a rod 45 which, as shown in FIG. 5, is connected to a crank 46 of a crankshaft 47 which is rotatably mounted within the support 11. The rod 45 is adjustably mounted longitudinally of the intermediate crank 43 via a suitable adjusting means 48 (FIG. 4).

As shown in FIG. 5, the crankshaft 47 carries a sprocket 49 which is connected via a chain 50 to a smaller sprocket 51 on a shaft 52 which is rotatably mounted in the sprocket frame 11. The shaft 52, in turn, carries a large sprocket 53 which is connected via a chain 54 to a smaller sprocket 55 which is connected with a stub shaft 56 on which the flywheel 15 is mounted. As indicated, the flywheel 15 is able to rotate concentrically about the crankshaft 47. To this end, suitable bearings (not shown) are provided to journal the crankshaft 47 within the flywheel 15.

During operation, as the crankshaft 47 rotates through 360°, the support shaft 41 (FIG. 4) oscillates up and down through a total angle of from 30° to 60°. The extent of this oscillation is controlled by adjusting the effective length of the intermediate crank 43 on the support shaft 41. This is accomplished by adjusting the position of the rod 45 via the adjusting means 48 along the length of the crank 43.

Referring to FIG. 6, wherein like reference characters indicate like parts as above, the adjusting means 48′ may alternatively be in the form of a block 57 which is pivotally connected to the connecting rod 45 via a pin 58 and which is slidably mounted along the crank 43. In addition, a threaded screw 59 which carries a knob 60 at one end is rotatably mounted in blocks 61, 62 which are fixed on the crank 43 and threaded through a suitable threaded bore within the block 57. Hence, by turning the knob 60, the block 57 can be slid along the length of the crank 43 to adjust the position of the rod 45.

Referring to FIG. 7, the exerciser 10′ may be provided with a single handrail 63 in the form of an upstanding post 64 with a cross-bar 65. The cross-bar 65 may also be adjusted to different heights via a pin 66 and multi-hole arrangement 67 in the post 64.

Referring to FIG. 8, in order to make the exerciser more compact, the platform 13 may be mounted by pairs of rocker arms 68 which are pivotally mounted on the support frame 11 on opposite sides of the platform 13. As indicated, each of the rocker arms 68 is of L-shape and is pivoted via a pivot pin 69 on suitable brackets 70 of the support frame 11. Further, each of the horizontal legs of a rocker arm 68 is pivotally connected via a pivot 71 to the platform 13 while the vertical legs are connected to each other via a horizontal strut 72. In addition, the two rear rocker arms are coupled together by a shaft (not shown) which is made to rock back and forth through about 50° by connection to a crankshaft (not shown), which, in turn, is connected to a flywheel (not shown). The various sprockets, chains, belts and the like can also be located to the sides of the platform 13 rather than behind the platform 13 so as to further shorten the exerciser.

Of note, various modifications may be made in the exerciser. For example, a single arm assembly may be used to support the platform 13. In this case, the lower strut of the arm assembly can carry the weight while the upper strut keeps the platform level. This arm assembly must, however, be able to carry the torque exerted on the platform should the user inadvertently place more weight on one side than on the other.

Likewise, conversion from rotary to reciprocal motion and vice versa can be accomplished with cams or with a wobble plate rather than with a crank and connecting rods. One advantage of a wobble plate arrangement is that the axes of the shaft are vertical. In some cases, the exerciser can then be made more compact.

Further, in connecting the crankshaft to the flywheel, use may be made of gear belts or gears in place of chains or gears.

The starting of the exerciser can be facilitated if a horizontal coil spring is attached to one of the cranks. Ordinarily, the exerciser would stop with the platform at the bottom dead center position. In this case, it would be necessary to turn the flywheel several times in order to start the motion. The spring, however, exerts a force which partially offsets that of gravity so that the platform does not stop at the bottom dead center position. Thus, stepping on the platform causes the flywheel to rotate, thus, easing starting.

Further, the exerciser may be modified so as to provide exercise for the arms as well as the legs. In this case, the cross-bar handrail can be connected so as to move down when the platform moves up and vice versa. The resultant exercise motion would be similar to doing the breast stroke with a porpoise kick. This requires use not only of the muscles of the arms and legs but also of the stomach and back. The required cross-bar motion can be achieved by placing the cross-bar at one end of a horizontal rod which is connected at midpoint to a vertical support bar via a pivot and by driving the other end of the horizontal rod by a strut connected to the platform or some other point on the arm assemblies.

Still further, it is possible to replace the flywheel with an "electronic flywheel" consisting of a torque motor, a tachometer and an electronic control system for the motor which causes the motor to produce torque proportional to the rate of change of angular velocity as measured by the tachometer.

The exerciser may also be constructed with auxiliary means to add losses to the machine to control the effort to the user. For example, if the user, by flexing his knees, moves his center or gravity up and down sinusoidally relative to the platform through a distance of B meters while the platform moves up and down sinusoidally relative to the ground through a distance of A meters, then the maximum energy which can be given to the exerciser each second by the user is found to be (MAB $\pi^3 f^3$) joules/second, i.e. P watts. Here M is the mass of the user in kilograms and f is the frequency at which the platform goes up and down; the power transmitted to the exerciser varying as the cube of the frequency. A maximum frequency of operation exists because if the platform goes up and down too fast the user's feet will lose contact with the platform near the peak of upward motion of the platforms. This occurs when $2(\pi f)^2(A^2+B^2)^{\frac{1}{2}}$ is equal to 10, the accelleration of gravity. For example, when A is 0.25 meter and B is 0.125 meter the maximum frequency is found to be 1.35 Hz.

The power delivered to the exerciser is by no means the same as that expended by the user to lift his body. This lifting must be done against by the combined accelerations of gravity and that of the platform and so is greater than the classical value "Mgh". The lifting power is found to be (10.MBf)+(0.5 P) where P is the power delivered to the exerciser. At the maximum frequency, the power P is of the order of 80% of the lifting power. Thus, the "efficiency" is quite good and the exerciser can be used as a manually powered electric generator or water pump.

The way that the exerciser makes demands on the user depends on the way in which the added losses vary with frequency. If the losses are constant regardless of frequency, the user will have to work much harder to keep the platform going as the platform slows down. A gentler mode of operation is achieved if no load is added until the exerciser reaches a certain minimum speed. The load may then be increased gradually as the speed rises above the minimum value. One way to achieve this ideal characteristic is to connect the flywheel to a DC generator with constant field excitation (or permanent magnet field) and to connect the output to a resistor placed in series with a stack of silicon diodes. Alternatively, an alternator with a rectifier can be used in place of the DC generator.

An exact measurement of the electrical power output of the exerciser can be made with a read-out means 73, such as a watt meter mounted for example on the handrail post 64 (FIG. 4).

Various non-electrical means may also be used to add an extra load of adjustable size on the exerciser. One of the simplest consists of a hydraulic shock absorber which may be connected between the platform and the support frame. Alternatively, a disc of copper or aluminum can be attached to the flywheel and rotated between the poles of a permanent magnet. This will induce eddy currents in the disc and cause the magnet to exert a drag on the disc, the amount of which is determined by the degree to which the magnet overlaps the disc. Also, as shown in FIG. 4, the support shaft 41 may carry a crank 74 which is connected via a rod 75 to a shock absorber (not shown) which is fixed to the support 11. As above, the rod 75 is adjustably mounted longitudinally of the crank 74 via an adjustment means 76.

The exerciser may also be modified to provide for an arm exercise only. For example, a U-shaped frame consisting of a pair of upstanding arms or levers and a horizontal cross-bar may be connected with the arm assemblies 16 for pivoting in a back and forth motion by a user standing behind the rear of the exerciser. In this case, the user does not stand on the platform 13 but on a stationary floor or an extension of the exerciser frame. Further, by grasping the cross-bar of the U-shaped frame and moving the cross-bar with a rocking rhythm, the exerciser 10 can be actuated.

The invention thus provides an exerciser which is of relatively simple construction which can be used in the home, gymnasium or elsewhere. Further, the exerciser is enjoyable to use. In this respect, the exerciser employs a flywheel which, when accelerated to a sufficient speed, possesses a kinetic energy many times that required to lift the user one time; the energy losses being provided by the user either by flexing of his knees in synchronism with the motion of the platform and/or synchronized lifting of weights held in the hands and/or synchronized exertion of pressure on a handrail connected to the exerciser.

In operation, the user bends his knees in synchronism with the platform motion exerting a greater force when the platform moves down and supplying net energy to the flywheel over a complete cycle. If the flywheel is not "loaded" this energy serves to accelerate the flywheel. If a load on the flywheel extracts energy for each cycle equal to that added by the user, then the speed of the flywheel remains constant. By adjusting the load, the user can vary the amount of work that must be expended in order to operate the exerciser.

What is claimed is:

1. A Knee flex exerciser comprising a horizontally disposed platform first means mounting said platform for reciprocating in a vertical direction while maintaining said platform level;

a low speed rotary shaft;

a conversion means connecting said first means to said shaft to convert a reciprocating motion of said platform to a rotary motion of said shaft and vice versa;

a high-speed rotary shaft;

a transmission connecting said low-speed shaft to said high-speed shaft; and a flywheel mounted on said high speed shaft for rotation therewith.

2. A knee flex exerciser as set forth in claim 1 which further comprises means connected to said flywheel for dissipating energy therefrom.

3. A knee flex exerciser comprising a stationary frame;

a platform;

first means mounting said platform on said frame for reciprocating in a vertical direction while manufacturing said platform level;

a flywheel rotatably mounted in said frame; and second means connecting said platform with said flywheel for transmitting a reciprocating up and down motion of said platform to a rotary motion of said flywheel and vice versa.

4. A knee flex exerciser as set forth in claim 3 wherein said first means includes a parallelogram arrangement of struts pivotally connected to said frame and to said platform.

5. A knee flex exerciser as set forth in claim 4, wherein said second means includes a high speed shaft mounting said flywheel thereon, a low speed shaft, a transmission connecting said high speed shaft to said low speed shaft and a conversion means connecting said low speed shaft to said struts to convert a rotary motion of said low speed shaft to a reciprocating vertical motion of said platform.

6. A knee flex exerciser as set forth in claim 5 wherein said conversion means includes a crankshaft, a crank mounted on said crankshaft, a connecting rod connecting said crank to one of said struts and a chain connecting said low speed shaft to said crankshaft.

7. A knee flex exerciser as set forth in claim 3 wherein said second means includes a high speed shaft mounting said flywheel thereon, a low speed shaft, a transmission connecting said high speed shaft to said low speed shaft and a conversion means connecting said low speed shaft to said first means to convert a rotary motion of said low speed shaft to a reciprocating vertical motion of said platform.

8. A knee flex exerciser as set forth in claim 3 which further comprises means connected to said flywheel for dissipating energy therefrom.

9. A knee flex exerciser as set forth in claim 3 which further comprises an upstanding handrail mounted on said frame.

10. A knee flex exerciser as set forth in claim 3 which further comprises at least one damping means connected between said platform and said frame for dissipating a load on said platform.

11. A knee flex exerciser as set forth in claim 3 wherein said first means includes a single arm pivotally connected to said frame.

12. In an exerciser, the combination comprising
a stationary support frame;
at least one arm assembly pivotally connected at one end to said support frame;
a load receiving board articulated to said arm assembly at an opposite end of said arm assembly;
a low speed rotary shaft;
a conversion means connecting said arm assembly to said shaft with said arm assembly being located between said board and said conversion means, said conversion means acting to convert a pivotal reciprocating motion of said arm assembly and a reciprocating motion of said board to a rotary motion of said shaft and vice versa;
a high speed rotary shaft;
a transmission connecting said low-speed shaft to said high-speed shaft; and
a flywheel mounted on said high-speed shaft for rotation therewith.

13. The combination as set forth in claim 12 wherein said load receiving board is articulated to said arm assembly for reciprocating in a substantially vertical path.

14. The combination as set forth in claim 13 which further comprises means for adjusting the excursion of said board.

15. The combination as set forth in claim 12 which further includes a readout for indicating the output of said exerciser.

16. The combination as set forth in claim 12 which further comprises a frame having at least one upstanding arm connected to said arm assembly for pivoting in a back and forth motion.

17. In an exerciser, the combination comprising
a horizontally disposed load receiving member;
at least one arm assembly articulated to said load receiving member for mounting said member for reciprocating in a substantially vertical path while maintaining said platform level;
a rotatably mounted flywheel; and
a conversion means connecting said arm assembly with said flywheel to convert a reciprocating motion of said load receiving member to a rotary motion of said flywheel.

18. The combination as set forth in claim 17 wherein said load receiving member is a platform and which further comprises a support frame having said arm assembly mounted thereon and at least one upstanding handrail supported on said frame.

19. The combination as set forth in claim 18 which further comprises means connected to said flywheel for dissipating energy therefrom.

20. In an exerciser, the combination comprising
at least one pivotally mounted arm assembly;
a low speed rotary shaft;
a conversion means connecting said arm assembly to said shaft to convert a reciprocating motion of said arm assembly to a rotary motion of said shaft and vice versa;
a high speed rotary shaft;
a transmission connecting said low-speed shaft to said high speed shaft;
a flywheel mounted on said high-speed shaft for rotation therewith;
a load receiving board articulated to said arm assembly for reciprocating in a substantially vertical path; and
means for adjusting the excursion of said board including a support shaft, a first crank secured to and between said support shaft and said arm assembly, a second crank secured to said support shaft, a rod adjustably mounted longitudinally of said second crank and connected to said conversion means.

21. The combination as set forth in claim 20 which further comprises a third crank secured to said support shaft, and a shock absorber adjustably secured between and to said third crank and a fixed point to dissipate energy.

22. In an exerciser, the combination comprising
a stationary support frame;
at least one arm assembly in which the arm assembly is a parallellogram arrangement, said arm assembly pivotally connected at one end to said support frame
a low speed rotary shaft;
a conversion means connecting said arm assembly to said shaft to convert a pivotal reciprocating motion of said arm assembly to a rotary motion of said shaft and vice versa;
a high speed rotary shaft;
a transmission connecting said low-speed shaft to said high-speed shaft; and
a flywheel mounted on said high-speed shaft for rotation therewith.

* * * * *

UNITED STATES PATENT AND TRADEMARK OFFICE

CERTIFICATE OF CORRECTION

PATENT NO. : 4,470,597

DATED : September 11, 1984

INVENTOR(S) : Richard McFee

It is certified that error appears in the above-identified patent and that said Letters Patent is hereby corrected as shown below:

| Column | Line | Change From | To |
|---|---|---|---|
| 2 | 6-7 | regards | -regard- |
| 8 | 58-59 | manufacturing | -maintaining- |

Signed and Sealed this

*Nineteenth* Day of *February 1985*

[SEAL]

*Attest:*

DONALD J. QUIGG

*Attesting Officer*

*Acting Commissioner of Patents and Trademarks*